US005398423A

United States Patent [19]

Smith

[11] Patent Number: 5,398,423

[45] Date of Patent: Mar. 21, 1995

[54] STRAIGHT EDGE APPARATUS FOR LAYING CERAMIC TILE

[76] Inventor: Allen L. Smith, 1435 W. 750 North, St. George, Utah 84770

[21] Appl. No.: 85,308

[22] Filed: Jun. 29, 1993

[51] Int. Cl.[6] ..... G01B 1/00; G01C 9/00; B43L 7/00

[52] U.S. Cl. ..... 33/526; 33/518; 33/376; 33/DIG. 20

[58] Field of Search ..... 33/526, 371, 376, 518, 33/DIG. 16, DIG. 20

[56] References Cited

U.S. PATENT DOCUMENTS

| | | | |
|---|---|---|---|
| 1,941,404 | 12/1933 | Lansing | 33/518 |
| 3,217,393 | 11/1965 | Johnson | 33/526 |
| 3,744,141 | 7/1973 | Strickland, Sr. | 33/526 |
| 4,635,414 | 1/1987 | Allen | 33/376 |
| 5,208,990 | 5/1993 | Woerlein | 33/518 |
| 5,263,260 | 11/1993 | Smith | 33/526 |

*Primary Examiner*—Christopher W. Fulton
*Attorney, Agent, or Firm*—Terry M. Crellin

[57] ABSTRACT

Straight edge apparatus for setting a level, second row of tile in the tub splash above an upper side edge of a tub, and extendable straight edge apparatus are disclosed. The apparatus for setting the second row of tile comprises and elongate straight edge formed by a substantially flat, elongate member having at least one straight side edge and a width that is less than the side dimension of the tile being laid. A flat flange extending substantially perpendicular from a straight edge of the flat, elongate member, and at least two, spaced apart leg means of adjustable length extend from the flat, elongate member in a direction away from the float flange on the flat, elongate member. The flat elongate member can be set flatwise against a wall on which the tile of the tub splash is to be set, with distal ends of the leg means resting on the upper side edge of the tub and being adjusted in length so that the flat flange is level. A second embodiment of straight edge is disclosed that comprises two nested angle members that can slide in telescopic movement. Channel clips are used to secure the nested angle members as a single unit. The effective length of the straight edge can be adjusted by extending the nested angle members and thereby vary the effective length of the straight edge.

2 Claims, 2 Drawing Sheets

STRAIGHT EDGE APPARATUS FOR LAYING CERAMIC TILE

BACKGROUND OF THE INVENTION

1. Field of the Invention

The present invention relates to straight edge apparatus used in laying tile.

2. State of the Art

Straight edge devices have been used widely in floating mortar base on walls and floors that are to have ceramic tile laid thereon. The straight edge devices of the prior art are elongate angle members having a flat base and a flat flange extending from one side edge of the flat base. The tile setter usually has several such straight edges, with each straight edge being of a different length. Heretofore, there has been no suggestion of a variable length straight edge that will take the place of the various individual straight edges as now used by tile setters.

Setting tile on the tub splash above a tub that is not level has always been a time consuming, hard job. Heretofore, a first row of tile is laid adjacent to the upper side of the tub. To make the row of tile level, many of the tiles have to be cut and then placed on a line formed in the mortar and mastic onto which the tile is being laid. The job is tedious and in many installations, the tile layer must continuously make adjustments in the subsequent rows of tile due to the inability to adequately level the first row.

There has been no straight edge tool heretofore that is adapted to be used in laying the second row of tile above the tub prior to the first row. If this second row could be laid in an absolute level orientation, the tile in the first row could then be individually cut and laid. All rows above the second row would then be in level, and the tile layer would not have to be continuously making adjustments in the spacings between tile as he lays the third and subsequent rows of tile.

BRIEF DESCRIPTION OF THE INVENTION

A principal objective of the invention is to provide a novel straight edge whose effective length can easily and quickly be adjusted. This will allow the tile layer to use one straight edge instead of the three or four various length straight edges which are commonly found in a tile layer's tool kit.

Another objective of the present invention is to provide a novel straight edge apparatus used in laying the second row of tile in the tub splash above a tub. If the tub is out of level, the straight edge apparatus of the present invention will allow the second row of tile to be quickly laid in a level row. The first row of tile is then laid below the second row, and the tile of the first row is cut when necessary to properly fit in the first row. However, all rows above the first row will be in level, and the tile layer will not have the need to make continuous adjustments because of the failure to properly level the first row of tile.

The above objectives are achieved in accordance with the present invention by providing in one embodiment a novel, unique straight edge which is easily and quickly adjustable in its effective length. The straight edge comprises a pair of nested angle members consisting of flat, straight base members and flange members that extend from the one straight side edge of the base members substantially perpendicular from the base members. The angle members nest together with the base member of the inner angle member lying adjacent to the inner face of the base member of the other angle member, and with the flange of the inner angle member lying adjacent to the inner face of the flange of the other member. The inner angle member can move in sliding, telescopic-like movement relative to the other angel member. Channel clip members are provided for releasably connecting the two angle members together as a single unit in their nested position. The inner angle member can be moved so that it extends beyond the end of the outer angle member to any desired degree. The channel clip members then hold the inner angle securely to the outer angle in the desired position.

In a second embodiment of the invention, a straight edge apparatus is provided which can be used to lay the second row of tile above the top side of a tub. The apparatus is advantageously used to lay the second row of tile in a level condition, even though the tub itself may not be level. The apparatus comprises a straight edge that is positioned along the wall on which the tile of the tub splash is to be laid. Extendable leg members are provided on the straight edge apparatus to support the apparatus on the upper surface of the tub. The leg members can be adjusted up and down so that the straight edge can be leveled. The second row of tile above the tub is then laid, with the first row of tile being laid later after the straight edge apparatus has been removed. The second row of tile is level, and subsequent rows of tile can then be laid upwardly on the tub splash without necessitating tedious adjustments of the tile to overcome problems otherwise encountered if the first and second rows of tile are not laid in a level row. The first row of tile may require cutting of the tile. Generally, the straight edge apparatus is positioned so that a full tile will fit at the end of low end of the tub if the tub is out of level. Tiles in this row are then cut as necessary to fit correctly between the second row of tile and the top of the tub.

Additional objects and features of the invention will become apparent from the following detailed description, taken together with the accompanying drawings.

THE DRAWINGS

Preferred embodiments of the present invention representing the best mode presently contemplated of carrying out the invention are illustrated in the accompanying drawings in which.

DETAILED DESCRIPTION OF THE ILLUSTRATED EMBODIMENTS

Figure 1:
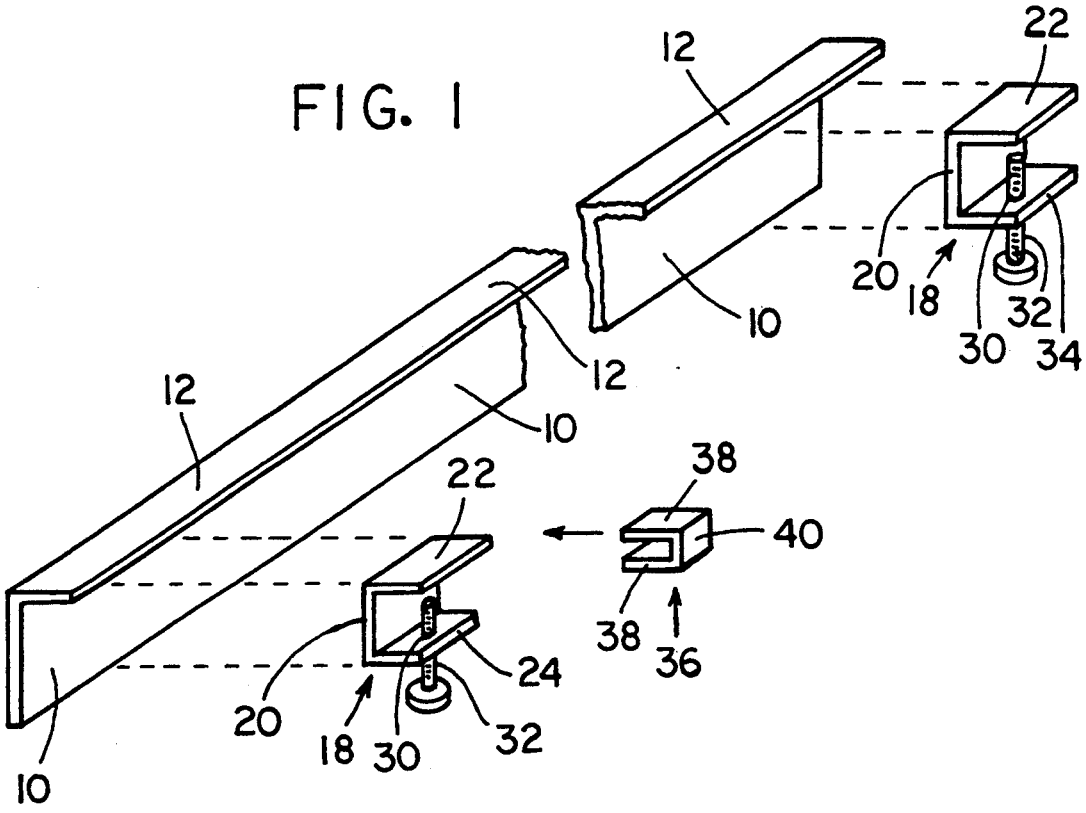
FIG. 1 is a pictorial representation of one embodiment of a straight edge in accordance with the present invention used in laying a second row of tile on the tub splash above the top surface of the tub.

Referring to FIG. 1 of the drawings, there is illustrated an apparatus in accordance with the present invention for setting a level, second row of tile in the tub splash above an upper side edge of a tub. The second row of tile is set in a level row even though the tub may be out of level. The apparatus comprises a substantially flat, elongate member 10 having at least one straight side edge and a width that is less than the side dimension of the tile being laid. Normally, tile has a dimension of about 4 inches, and the width of the elongate member 10 is preferably about 3.5 inches.

A flat flange 12 extends substantially perpendicular from the straight edge of the flat, elongate member 10. Advantageously, the flat elongate member 10 and the flat flange 12 are formed by a conventional straight edge used in setting tile. At least two, spaced apart leg means are provided. The leg means are of adjustable length and extend from the flat, elongate member 10 in a direction away from the flat flange 12 on the flat, elongate member 10. In one preferred embodiment of the invention, the adjustable leg means comprises removable leg jacks that are releasably attached to the flat flange 12 of the elongate member 10. In use, as will be further discussed hereinafter, the flat elongate member 10 is set flatwise against a wall on which the tiles of the tub splash are to be set.

The removable leg jacks preferably comprise short pieces of channel 18 formed by a flat base member 20 and first and second flanges 22 and 24 extending from opposite sides of the base member 20. The base member 20 is received flatwise against the inside surface of the flat elongate member 10, with the first flange 22 of the channel 18 received flatwise on the inside surface of the flat flange 12 of the elongate member 10.

A threaded opening 30 is provided in the second flange 24 of each channel 18, and an elongate threaded leg 32 is threaded in the opening 30 of the second flange 24. Clip members 36 are provided for releasably securing the first flange 22 of the channel 18 to the inside surface of the flat flange 12 of the elongate member 10. The clip members 36 preferably consist of channel clips having a generally U-shaped cross section with opposite legs 38 extending from a base portion 40. The opposite legs 38 form a spring clip that grips the opposite sides of the nested flat flange 12 of the elongate member 10 and the flat first flange 22 of the channel 18 when the channel clip members are pushed over the otherwise free side edges of these flanges.

Figure 2:
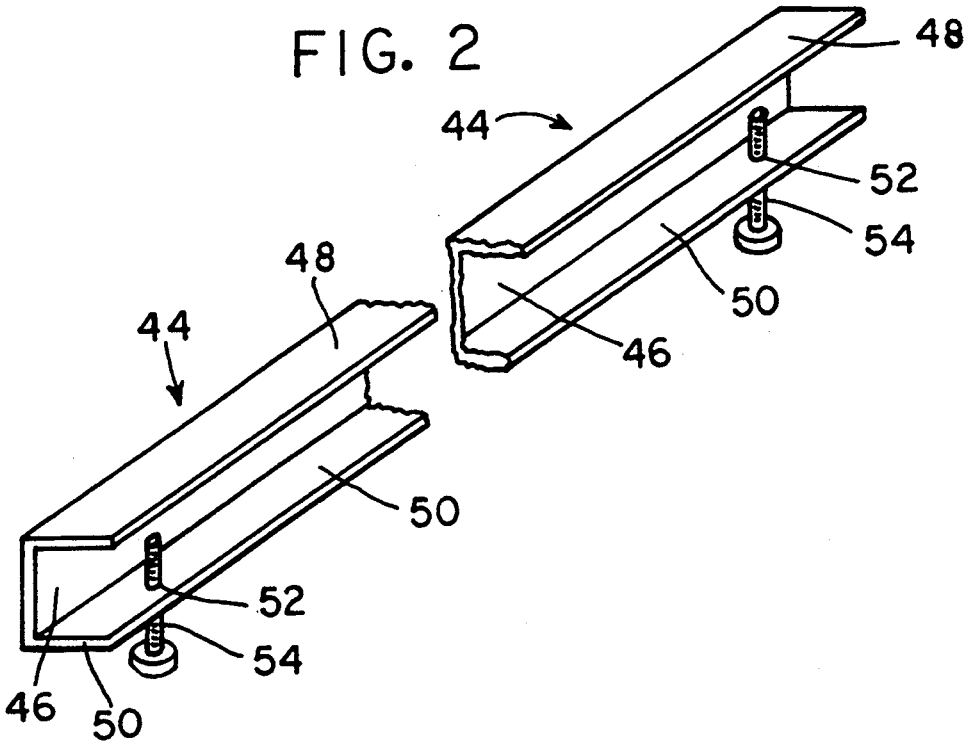
FIG. 2 is a pictorial representation of a second embodiment of a straight edge in accordance with the present invention used in laying the second row of tile on a tub splash.

Referring to FIG. 2, another embodiment of apparatus in accordance with the present invention is shown for setting a level, second row of tile in the tub splash above an upper side edge of a tub. In the embodiment of FIG. 2, the apparatus comprises an elongate channel 44 formed by a flat, straight edged, base member 46 and first and second flat flanges 48 and 50 that extend from opposite longitudinal sides of the base member 46. The base member has a width that is less than the side dimension of the tile being laid, and will generally be between about 2.25 and 3.5 inches.

At least two, spaced apart leg means of adjustable length are provided that extend from the second flat flange 50 in a direction away form the channel 44 in a plane that is essentially parallel with the base member 46 of the channel 44. The leg means preferably comprises spaced apart, threaded openings 52 in the second flange 50 of the channel 44. Elongate, threaded legs 54 are threaded in the openings 52 of the second flange 50 of the channel 44. The legs 54 can be threaded up and down with respect to the second flange 50.

The use of either of the embodiments shown in FIGS. 1 and 2 are essentially identical. The use of the embodiment of FIG. 2 will be discussed with reference to FIG. 3 of the drawings. As will become evident, the use of the embodiment of FIG. 2 is representative of the use of the embodiment of FIG. 1.

Figure 3:
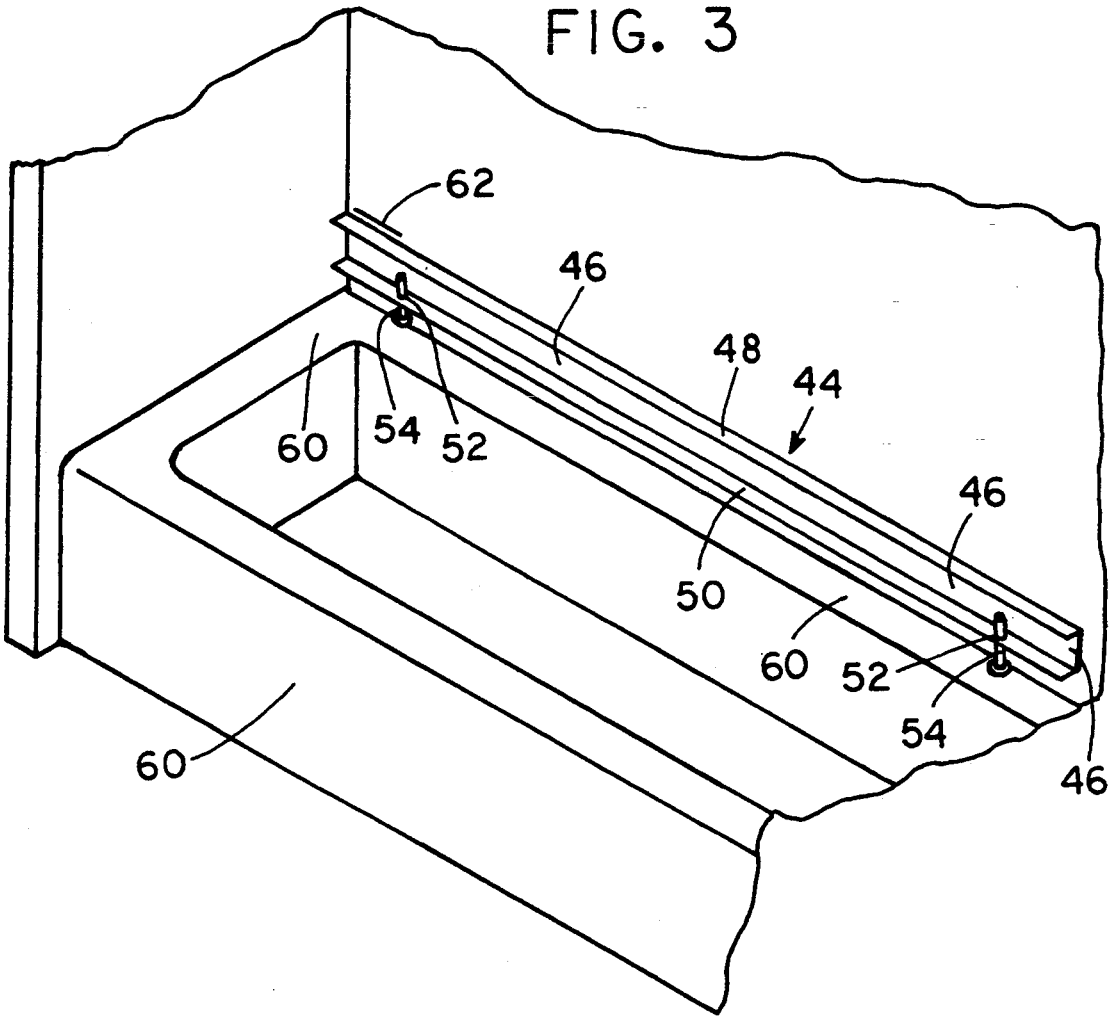
FIG. 3 is a pictorial representation of the positioned of the straight edge of FIG. 1 on the top of a tub in preparation for laying the second row of tile above the tub on the tub splash.

Referring to FIG. 3, the base member 46 of the channel 44 is set flatwise against a wall on which the tile of the tub splash is to be set. The distal ends of the legs 54 rest on the upper side edge of the tub 60, and the legs 54 are, as explained above, adjustable in length so that the flat first flange 48 of the channel 44 is level. To properly position the first flange 48 of the channel 44 at the proper elevation, a mark 62 is made on the wall wherein the mark 62 represents the elevation of one tile above the top side of the tub 60. This mark 62 is made at the lower end of the tub 60 if the tub 60 is not level. The one end of the channel 44 is adjusted by the leg 54 closest to that end so that the top edge of the first flange 48 aligns with the mark 62. The other leg 54 is then adjusted to raise or lower the other end of the channel 44 so that the top edge of the first flange 48 at the other end of the channel 44 is brought into level alignment with the mark 62. Mastic can be used between the base member 46 and the wall to help hold the straight edge apparatus in place. The second row of tile can then be laid along the top edge of the first flange 48. Subsequent rows of tile are laid on the second row, and little if any adjustment will be necessary in laying the tiles of the subsequent rows because the second row was made to be level. The tiles of the first row can be laid after the second row has been laid and the straight edge apparatus has been removed. Cutting of the tiles in the first row may be necessary if the tub 60 was not level.

Figure 4:
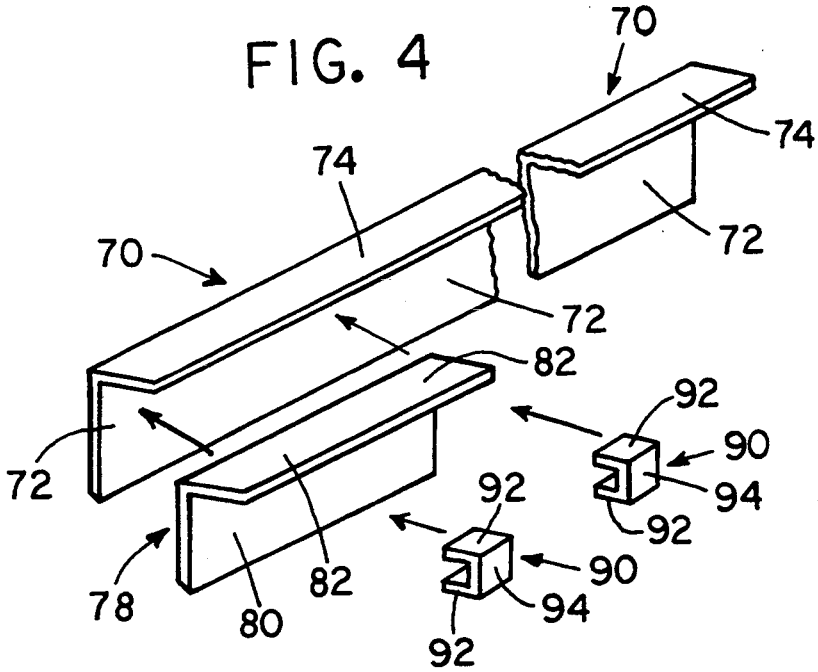
FIG. 4 is a pictorial view of an extendable straight edge in accordance with the present invention used in floating walls and floors with mortar in preparation for laying tile on the walls and floors.

An extendable straight edge for use in laying tile is illustrated in FIG. 4. The extendable straight edge comprises an elongate angle member 70 formed from a flat base member 72 having opposite, straight, longitudinal, first and second side edges. A flat flange 74 extends from the first of the side edges of the base member 72. The flange 74 is substantially perpendicular to the flat base member 72. The flat base member 72 preferably has a width of between about 2.25 and 3.75 inches and a length of at least about 18 inches. The flat flange 74 has a width of between about 0.5 and 1.75 inches and a length corresponding to the length of the flat base member 72.

An elongate extension angle member 78 is formed from a flat base member 80 having opposite, straight, longitudinal, first and second edges. A flat flange 82 extends from the first of the side edges of the flat base member 80 of the extension angle member 78. The flange 82 of the extension angle member 78 is substantially perpendicular to the flat base member 80 of the extension angle member 78. The flat base member 80 of the extension angle member 78 has a width such that the extension angle member 78 can nest snugly within the elongate angle member 70 for longitudinal, sliding movement along the elongate dimension of the angle member 70, with the second side edge of the extension angle member 78 being adjacent to the second side edge of the base member 72 of the elongate angle member 70. The flat base member 80 of the extension angle member 78 has a length of between about 12 inches and up to the length of the flat base member 72 of the elongate angle member 70, with the flat flange 82 on the extension angle member 78 having a length corresponding to the length of the flat base member 80 of the extension angle member 78. The flat flange 82 on the extension angle member 78 has a width such that when the extension angle member 78 is nested within the elongate angle member 70, distal side edges of the flat flange 74 on the elongate angle member 70 and the flat flange 82 on the extension angle member 78 lie alongside each other and are displaced from each other by no more than about 0.25 inch.

Means are provided for releasably attaching the elongate angle member 70 and the elongate extension angle member 78 as a single unit, with the elongate extension angle member 78 nested within the elongate angle member 70. The elongate extension angle member 78 can then be adjusted to extend at various distances from one end of the elongate angle member 70 to increase the effective length of the straight edge.

The means for releasably attaching the elongate angle member 70 and the elongate extension angle member 78 together as a single unit preferably comprises channel clip members 90 having a generally U-shaped cross section. Opposite legs 92 of the channel clip members 90 extend from a base portion 94 so that the opposite legs 92 form a spring clip that grips the opposite sides of the nested flat flanges 74 and 82 of the elongate angle member 70 and the elongate extension angle member 78 when the channel clip members 90 are pushed over the otherwise free side edges of the flanges 74 and 82.

Although preferred embodiments of the present invention have been illustrated and described, it is to be understood that the present disclosure is made by way of example and that various other embodiments are possible without departing from the subject matter coming within the scope of the following claims, which subject matter is regarded as the invention.

I claim:

1. Apparatus for setting a level, second row of tile in the tub splash above an upper side edge of a tub, even when the tub is out of level, said apparatus comprising a conventional straight edge used in setting tile comprising a substantially flat, elongate member having at least one straight side edge and a width that is less than the side dimension of the tile being laid and a flat flange extending substantially perpendicular from a straight edge of said flat, elongate member;

at least two, spaced apart leg means of adjustable length which extend from said flat, elongate member in a direction away from said flat flange on said flat, elongate member, said leg means comprising short pieces of channel formed by a flat base member and first and second flanges extending from opposite sides of said base member, so that the base member can be received flatwise against the inside surface of said flat elongate member with the first flange of said channel received flatwise on the inside surface of said flat flange;

a threaded opening in the second flange of each channel;

an elongate threaded leg that is threaded in said opening of said second flange; and a clip member for releasably securing the first flange of said channel to the inside surface of said flat flange, whereby the flat elongate member can be set flatwise against a wall on which the tile of the tub splash is to be set, with distal ends of the threaded legs resting on the upper side edge of the tub and being adjusted in length so that the flat flange is level.

2. An extendable straight edge for use in laying tile comprising an elongate angle member formed from a flat base member having opposite, straight, longitudinal, first and second side edges, with a flat flange extending from the first of said side edges, said flange being substantially perpendicular to the flat base member, said flat base member having a width of between about 2.25 and 3.75 inches and a length of at least about 18 inches, with said flat flange having a width of between about 0.5 and 1.75 inches and a length corresponding to the length of said flat base member;

an elongate extension angle member formed from a flat base member having opposite, straight, longitudinal, first and second edges, with a flat flange extending from the first of said side edges of the flat base member of said extension angle member, said flange of said extension angle member being substantially perpendicular to the flat base member of said extension angle member, said flat base member of said extension angle member having a width such that the extension angle member can nest snugly within the elongate angle member for longitudinal movement along said elongate angle member, with the second side edge of said extension angle member being adjacent to the second side edge of the base member of said elongate angle member, said flat base member of said extension angle member having a length of between about 12 inches and up to the length of the flat base member of said elongate angle member, with said flat flange on said extension angle member having a length corresponding to the length of the flat base member of said extension angle member, said flat flange on said extension angle member having a width such that when said extension angle member is nested within said elongate angle member, distal side edges of the flat flange on the elongate angle member and the flat flange on the extension angle member lie alongside each other and no more than about 0.25 inch from each other; and means for releasably attaching the elongate angle member and the elongate extension angle member as a single unit with the elongate extension angle member nested within said elongate angle member, said means for releasably attaching the elongate angle member and the elongate extension angle member together as a single unit consisting of channel clip members having a generally U-shaped cross section with opposite legs extending from a base portion, with the opposite legs forming a spring clip that grips the opposite sides of the nested flat flanges of said elongate angle member and said elongate extension angle member when the channel clip members are pushed over the otherwise free side edges of the flanges of said elongate angle member and said extension angle member, whereby the elongate angle extension member can be adjusted to extend at various distances from one end of said elongate angle member to increase the effective length of the straight edge.

* * * * *